United States Patent [19]

Lohrmann

[11] Patent Number: 4,652,160

[45] Date of Patent: Mar. 24, 1987

[54] TRANSPORTING DEVICE FOR MARGINAL PUNCHED WEBS

[75] Inventor: Gerhard Lohrmann, Elchingen-Ihalfingen, Fed. Rep. of Germany

[73] Assignee: Mannesmann Aktiengesellschaft, Dusseldorf, Fed. Rep. of Germany

[21] Appl. No.: 837,446

[22] Filed: Feb. 24, 1986

Related U.S. Application Data

[63] Continuation of Ser. No. 661,018, Oct. 15, 1984, abandoned.

[30] Foreign Application Priority Data

Nov. 18, 1983 [DE] Fed. Rep. of Germany ..... 3342105

[51] Int. Cl.[4] ..... B41J 11/30

[52] U.S. Cl. ..... 400/616.2; 226/74

[58] Field of Search ..... 400/616, 616.1, 616.2, 400/616.3; 226/74, 75, 170, 171, 172, 173; 474/111

[56] References Cited

U.S. PATENT DOCUMENTS

| | | | |
|---|---|---|---|
| 3,386,565 | 6/1968 | Carter | 226/170 X |
| 3,688,959 | 9/1972 | Staneck et al. | 226/75 |
| 4,462,531 | 7/1984 | Seitz | 226/74 X |

*Primary Examiner*—Charles A. Pearson

*Attorney, Agent, or Firm*—Cullen, Sloman, Cantor, Grauer, Scott, & Rutherford

[57] ABSTRACT

A transporting device for marginal punched single-layered or multiple-layered webs of material, in particular for record carriers in a printer, is provided. Such a transporting device serves for marginal punched single-layered or multiple-layered webs of material (1), in particular for paper record carriers in a printer, and consists of frames (2) on both sides of the web of material (1) which are adjustable to the width of the web of material, with sprockets (*3a,3b*) in each case rotatably mounted thereon, of a sprocket drive, of continuous toothed belts (6) stretched around the sprockets (*3a,3b*) and provided on the inner side (9) with teeth (10), on which belts transporting pins (8) are attached on the outer side (7), which engage force-locking and form-locking into the marginal perforations of the web of material (1) and further consists in each case of a guide plate (11 or 12) able to be pivoted parallel to the web of material (1) up to a guiding slit (14) to the frames (2), which plates cover the web of material (1) and which are provided in each case with a recess (15) for the unimpeded movement of the transporting pins (8) and further consist of means to press the web of material (1) against the toothed belts (6).

3 Claims, 2 Drawing Figures

TRANSPORTING DEVICE FOR MARGINAL PUNCHED WEBS

Figure 1:
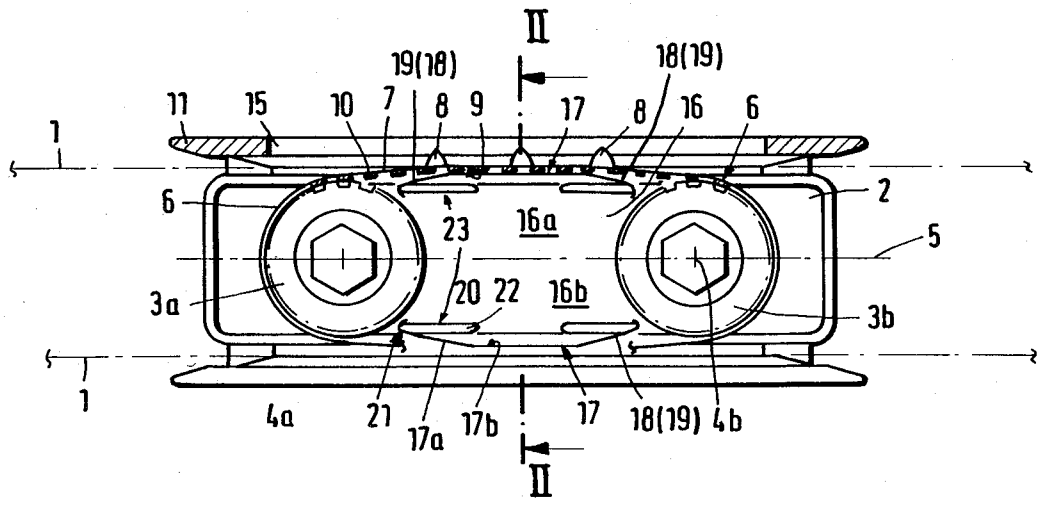

This is a continuation of U.S. patent application Ser. No. 661,018, filed Oct. 15, 1984, now abandoned.

The invention relates to a transporting device for marginal punched single-layered or multiple-layered webs of material, in particular for record carriers in a printer, consisting of frames which are adjustable on both sides of the material web to the width of the material web, with sprockets rotatably mounted in each case thereon, of a sprocket drive, of continuous toothed belts stretched around the sprockets and provided on the inner side with teeth, on which belts transporting pins are attached on the outer side, which engage the marginal perforations of the web of material and further consisting in each case of a guide plate adapted to be pivoted parallel to the web of material up to a guide slit to the frames, which plates cover the web of material and which are provided in each case with a recess for the unimpeded movement of the transporting pins, further consisting of means to press the web of material against the toothed belts.

Such pairs of frames as guidance for the web of paper in printers, in particular in matrix printers, serve in addition for the accurate feed of paper for serial printing, or printing by the line, of characters. In this, transporting pins operatively extend into the marginal perforations of the web of material, which pins in their axial cross-section are in principle tapered and convex. These transporting pins have at their base the diameter which corresponds to the diameter of the marginal perforations, in which at least theoretically the diameter of the marginal perforations must still be greater by a small amount.

For an accurate lateral guidance and for an accurate feed it is, however, also necessary to keep the web of material in the plane in which the said diameter of the marginal perforations as largely as possible coincides with the base diameter of the transporting pins. This problem of the position of the web of material in vertical sense at the same time represents a problem of the thickness of the web of material, i.e. which type of material is used in the printer and what number of layers (original with several copies) is required.

It is known (DE Pat. No. 21 37 975) to equip the transporting device indicated in the introduction with a pressure device which is able to be flapped away and locked, to secure the web on the transporting member. For this a continuous cover belt is used, with perforations in conformity, as regards spacing and size, with the transporting pins, which belt runs freely with the transporting member, in which the cover belt is resiliently pre-stressed onto the transporting member. This known solution leads, in the locked position of the pressure device, to a small distance of the cover belts above the conveyor belt. Such a pivotable pressure shoe further leads to a very costly and also high type of construction. From the otherwise very much space-saving, low built tractor flap, on the basis of the known proposal there arises a housing attached to a lever, for the actuation of which further extensive provisions must be made, such as for example a tension spring, arresting means and such.

The invention is based on the problem of ensuring a secure guidance of the web of material free of play, without such a pressure shoe, ie. maintaining a conventional tractor flap, and namely on the basis of simple means.

The problem posed is solved in that the means for the pressing of the web of material against the toothed belts are located within the frame and are arranged in the space between two sprockets, and that the contact pressure is exerted onto the side of the toothed belt on which the teeth of the toothed belt are provided. The advantages exist in the approved tractor flap, in the freedom from play which is nevertheless to be achieved, likewise independently of the number of copies to be printed, in the particular utilization of space, in the protected accommodation of the pressure means, which do not have to be constructed so as to be pivotable away and therefore require a simplified structure.

In accordance with the simplication in structure which is striven for, a further development of the invention, is the fact that the pressure means in each case consist of a spring element, which rests with its outer side against the toothed belt. The pressure means therefore consist of one single part. Such a part is also formed by a simple pre-stressed pressure spring, which rests intermediate its ends against the inner sides of the toothed belt.

Advantageously, the spring element is formed from a pre-stressed flat spring. This construction of the pressure means permits an extremely favorable manufacture in terms of costs.

The co-operation of the pressure means with the inner side of the toothed belt is further facilitated in that the flat spring has in inclined run-up part and an inclined run-out part.

According to a further improvement of the invention, provision is made that the flat spring is provided on its ends with bent over sections and that the bent over sections are detachably fastened to the frame. The invention is therefore also associated with a negligible amount of installation work, so that there is also a favorable installation in terms of costs.

Similarly, a fundamental alteration to the frame construction is not necessary. The arrangement of the pressure means takes place such that the attachment for the bent over sections of the ends of the flat spring consist of ribs, projections or suchlike, which are firmly provided on the frame.

So far as the web of material can be introduced from both sides in the printer, or a deflection of the web of material takes place in the tractor, it is additionally advantageous that the pressure means in each case are associated to both inner sides of the toothed belt axially symmetrically to the central longitudinal axis of the frame.

An example embodiment of the invention is represented in the drawing and will be described in further detail below.

Figure 2:
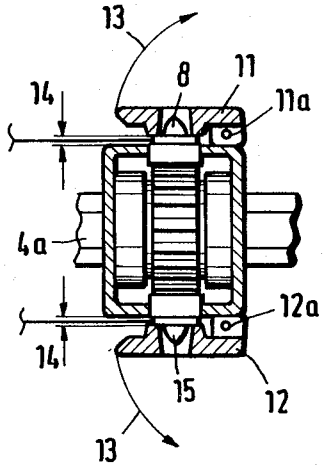

FIG. 1 shows a side view of the transporting device transversely to the direction of transporting the web of material and FIG. 2 shows a vertical cross-section through the transporting device according to line II—II in FIG. 1.

The transporting device for marginal punched single-layered webs of material 1 is provided for a matrix printer, which itself is not shown. In each case two frames 2 are able to be adjusted, sliding on guideways, to the width of the web of material (width of paper web). Located on the frame 2 in each case are at least two sprockets **3*a* and 3*b*, which are rotatably mounted on the axes of rotation 4*a* and 4*b*, which are arranged at a distance one behind the other on the central longitudinal axis 5 of the respective frame 2. At least one of the sprockets 3a,3b is coupled to a rotary drive, not shown in further detail, via one of the axes of rotation 4a and 4b. In each case one continuous toothed belt 6 is stretched around two sprockets 3a and 3b, which belt carries transporting pins 8 on the outer side 7 and on the inner side 9 is provided with teeth 10. The transporting pins 8 operatively extend into the web of material 1, whereby at least one transporting pin 8 must be fully in engagement, or preferably one to two transporting pins or more, depending upon the thickness of the web of material 1 (also depending upon the number of copies which are to be printed.) The number of transporting pins 8 therefore determines the spacing of the sprockets 3a and 3b. The guidance of the web of material 1 upwards is limited by the guide plates 11 and 12. Each of the guide plates 11 and 12, which are generally also designated as tractor flaps, is pivotable about an axis 11a or 12a in the direction of the arrows 13 in the open position. The guide plates 11 and 12, with the frame 2, in each case form a guiding slit 14 (FIG. 2), of a height from 0.6 to 1.2 mm. This guiding slit 14 can not be altered. The guide plates 11 and 12 have a recess 15 into which the transporting pins 8 run freely in and out again, ie. extend into it without being impeded by the guide plate 11 or 12**.

The means for the pressing of the web of material 1 are located in the space 16 between the sprockets 3a and 3b. The forces hereby exerted act from the interior of the space 16 outwards, ie. against the teeth 10 of the toothed belt 6. The transporting pins 8 are hereby pressed with their foot fully into the marginal perforations of the web of material 1, so that a central guidance of these marginal perforations and hence of the entire web of material 1 is brought about. The forces for this derive from the spring element 17, which rests with its outer side 17a against the toothed belt 6. The spring element 17 in the example embodiment shown is formed from a flat spring 17b. The friction between the flat spring 17b and the adjacent toothed belt 6 with the teeth 10 is reduced by the inclined run-up part 18 and the inclined run-out part 19. The ends 20 of the flat spring 17b have bent over sections 21, which are detachably fastened to the frame 2. The flat springs 17b may therefore be easily inserted or exchanged.

The attachment 22 is formed by ribs 23, which are firmly provided on the frame 2, ie. are integrally cast in manufacture from metal or are molded on in manufacture from synthetic material.

The pressure means, ie. the spring elements 17 are associated in each case to both inner sides 16a and 16b, and namely symmetrically to the central longitudinal axis 5 of the frame 2. Despite the arrangement of the spring elements 17 on both sides, the space 16 which is available is only occupied to a minimum. The arrangement on both sides further serves for the arbitrary direction of feeding the web of material 1, either from left to right or vice versa, or also as feeding into the upper or lower guiding slit 14 (FIG. 2).

I claim:

1. A transporting device for margin punched webs comprising:

a frame supporting at least two sprockets around which an endless belt extends;

a sprocket drive for moving the belt in a continuous path around the sprockets;

longitudinally spaced transporting pins upon and along the belt directed outwardly therefrom for engaging similarly spaced marginal perforations in said web;

a guideplate along one edge pivotally mounted upon said frame facing a portion of said continuous path that extends between the sprockets and having an elongated recess for receiving the distal ends of the transporting pins;

said guideplate being mounted for pivotal movement about an axis substantially parallel to said portion of the continuous path of the belt;

said belt adapted to engage the undersurface of said web;

longitudinally spaced ribs spaced between said sprockets rigidly mounted on and projecting from said frame and underlying said belt;

an elongated leaf spring yieldably bearing against said belt, said leaf spring being located within the continuous path followed by the belt around the sprockets and yieldably urging the belt toward the guideplate as it moves along said path portion to hold said web between the belt and guideplate;

said leaf spring having inclined ramp portions formed on opposite ends of a central portion, said ramp portions terminating in reversely bent sections at the ends of said ramp portions, said reversely bent sections comprising the sole means for detachably attaching and rigidly fastening said leaf spring to said ribs wherein the central portion of said leaf spring is yieldably supported on the ribs solely by the ramp portions.

2. In the transporting device of claim 1, wherein the belt has longitudinally spaced teeth on its inner side which engage the sprockets as the belt moves in its continuous path, and the teeth move over and are supported by the pre-stressed flat spring.

3. In the transporting device of claim 1, a second guideplate underlying and spaced upon said first guideplate and sprockets, along one edge pivotally mounted upon said frame and facing a portion of the return flight of said continuous path between the sprockets and having an elongated recess for receiving the distal ends of the transporting pins;

second longitudinally spaced ribs mounted on and projecting from said frame within and overlying the belt;

a second elongated leaf spring yieldably bearing against said belt, said leaf spring being located within the continuous path followed by the belt around the sprockets and yieldably urging the belt toward the second guideplate as it moves along said path portion on the return flight to hold said web between the belt and guideplate;

said second leaf spring having inclined ramp portions formed on opposite ends of a central portion, said ramp portions terminating in reversely bent sections at the ends of said ramp portions, said reversely bent sections comprising the sole means for detachably attaching and rigidly fastening said leaf spring to said ribs wherein the central portion of said second leaf spring is yieldably supported on the ribs solely by the ramp portions.

* * * * *